United States Patent [19]

Kondo et al.

[11] 4,389,131

[45] Jun. 21, 1983

[54] PRINTER WITH ELECTROMAGNETIC DRIVE YOKES

[75] Inventors: Hiroatsu Kondo, Zushi; Toshiaki Ozawa, Higashi; Hideaki Miyakawa, Yokohama, all of Japan

[73] Assignee: Canon Kabushiki Kaisha, Tokyo, Japan

[21] Appl. No.: 174,000

[22] Filed: Jul. 31, 1980

[30] Foreign Application Priority Data

Aug. 2, 1979 [JP] Japan ..... 54-98956

[51] Int. Cl.[3] ..... B41W 9/30

[52] U.S. Cl. ..... 400/157.2; 101/93.29; 335/266

[58] Field of Search ..... 400/157.2, 144.2; 101/93.03, 93.29, 93.42, 93.43, 93.33, 93.48; 335/268, 234, 265–267, 177–180, 182–184, 69, 81, 103, 147

[56] References Cited

U.S. PATENT DOCUMENTS

| | | | |
|---|---|---|---|
| 3,543,906 | 12/1970 | Hladky | 400/157.2 |
| 3,618,514 | 11/1971 | Nyman | 400/157.2 X |
| 3,804,008 | 4/1974 | Hoyer | 400/157.2 X |
| 4,166,261 | 8/1979 | Meinke et al. | 335/268 X |
| 4,195,277 | 3/1980 | Leicht | 335/268 X |
| 4,221,163 | 9/1980 | Anderson | 335/234 X |
| 4,242,955 | 1/1981 | Wasserman | 400/157.2 |

FOREIGN PATENT DOCUMENTS

| | | | |
|---|---|---|---|
| 2704123 | 8/1977 | Fed. Rep. of Germany | 400/157.2 |

OTHER PUBLICATIONS

Leicht "Magnetic Hammer Guide" Xerox Disclosure Journal, vol. 4, No. 2, Mar./Apr. 1979, p. 149.

Leicht "Rotary-to-Linear Actuator", Xerox Disclosure Journal, vol. 2, No. 4, Jul./Aug. 1977, p. 43.

*Primary Examiner*—E. H. Eickholt

*Attorney, Agent, or Firm*—Fitzpatrick, Cella, Harper & Scinto

[57] ABSTRACT

A printing hammer as a movable member holds a magnet integrally therewith, yokes having coils wound thereon are disposed substantially at right angles with the direction of movement of the movable member and in opposed relationship with the magnet, and a printing member is disposed in the direction of movement of the printing hammer.

9 Claims, 10 Drawing Figures

PRINTER WITH ELECTROMAGNETIC DRIVE YOKES

BACKGROUND OF THE INVENTION

1. Field of the Invention

This invention relates to a printer which effects printing on a recording medium by the impact of a printing hammer.

2. Description of the Prior Art

Recently, in impact type printers, along with the advance of the electronic technique, it has been common practice to replace mechanical components with electronic components and thereby improve the reliability of the printers. However, such printers require separate drive sources and various control system electronic elements for effecting the movement of the carriage thereof, rotation of the printing wheel, ink ribbon feeding, printing hammer operation, etc. and this has led to a disadvantage that such printers are more expensive than those which use mechanical components.

SUMMARY OF THE INVENTION

It is an object of the present invention to provide an inexpensive printer.

It is another object of the present invention to provide a printer having driving means including means for weakening the force maintaining a movable member in its present state and returning the same and means for generating a propulsion force driving the movable member in a certain direction.

It is still another object of the present invention to provide a printer which comprises a movable member provided with a magnet, yokes having coils wound thereon and disposed at right angles with the direction of movement of said movable member and in opposed relationship with said magnet, and a printing member for effecting printing on a recording medium disposed in the direction of operation of said movable member.

The invention will become fully apparent from the following detailed description thereof taken in conjunction with the accompanying drawings.

DESCRIPTION OF THE PREFERRED EMBODIMENTS

Figure 1:
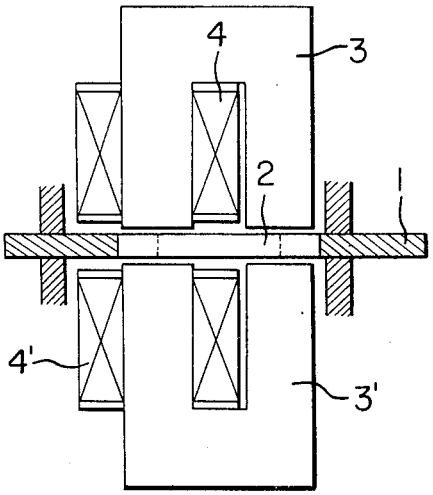
FIG. 1 is a cross-sectional view of a printing hammer mechanism used in the present invention.

In FIG. 1, reference numeral 1 designates a hammer, reference numeral 2 denotes a magnet magnetized to multipoles and embedded and fixed in the hammer, and reference numerals 3, 3' designate U-shaped yokes disposed so as to hold the hammer 1 as a movable member therebetween with a slight clearance interposed between the hammer and the yokes. Coils 4 and 4' are wound on the yokes 3 and 3', respectively. These yokes are disposed substantially at right angles with the direction of hammer movement.

Figure 2:
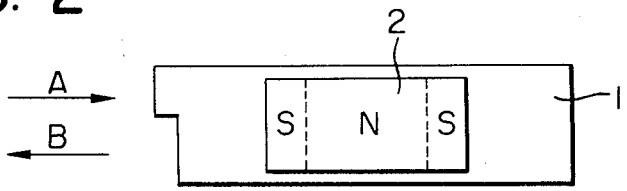
FIG. 2 is an elevational view of a hammer.
Figure 3:
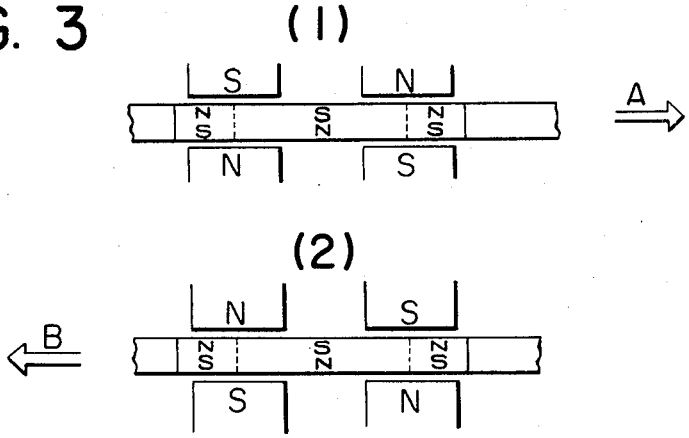
FIG. 3 illustrates the operation of the hammer.

In FIG. 2, the direction of arrow A is the non-printing direction and the direction of arrow B is the printing direction. To bias the hammer in the direction of arrow A, a current may be supplied to the coil 4 so that the yokes 3, 3' have the polarities as shown in FIG. 3(1). To bias the hammer in the opposite or printing direction, the yokes may be excited in the manner as shown in FIG. 3(2).

Figure 4:
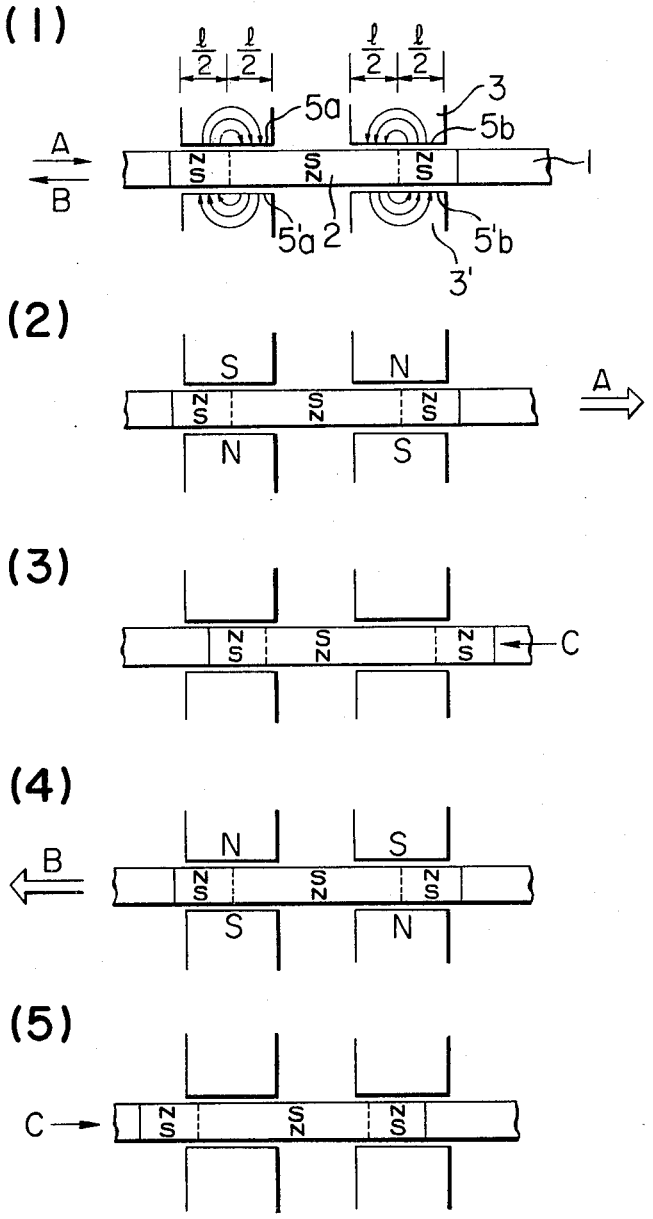
FIGS. 4(1)-4(5) illustrate the transition of the operation thereof.

FIG. 4(1) shows the positional relation between the yokes in their stationary state and the permanent magnet and the conditions of magnetic fluxes. Each yoke is constructed so that the polarization lines of the permanent magnet are located on the bisecting lines of the surface of each yoke opposed to the hammer (on l/2 when the length of each surface of each yoke is l). The position of these bisecting lines is not strict but has a tolerance. The magnetic fluxes by each yoke and the magnet in this condition are such as shown, and since the hammer is subjected to equal attractions from both yokes, it is never subjected to any one-sided force. This position is the home position of the hammer and at this time, the attraction between the magnet and the yokes acts as a force maintaining the hammer at its home position (hereinafter simply referred to as the maintenance force), so that the hammer is not readily moved even by extraneous impact. Also, this attraction between the magnet and the yokes acts as a return force which returns the hammer to its home position because, when the hammer is moved from its home position in the direction of arrow A or B, the magnetic fluxes are decreased and a force C which returns the magnetic fluxes to their initial condition is created. Thus, the stationary state is a very stable state and there is no necessity of providing a resilient member such as a spring for returning the hammer to its home position.

The movement of the hammer is more specifically shown in FIG. 4. In FIG. 4(2), to bias the hammer in the non-printing direction A, a current may be supplied to the coils 4, 4' wound on the U-shaped yokes 3, 3' of FIG. 1 so that each yoke assumes the polarity as shown. Thereby, attraction and repulsion act between the magnetic pole formed in each yoke and the different poles and the same poles of the permanent magnet to quickly bias the hammer in the direction of arrow A. The magnetic poles which generate the repulsion or attraction with respect to the permanent magnet 2 as the propulsion force of the hammer are not created in the yokes 3, 3' immediately after the current has been supplied to the coils, but at first, the current acts to decrease the maintenance force between the magnet 2 and the yokes 3, 3' shown in FIG. 4(1). When the supplied current is further increased after the maintenance force has been eliminated, magnetic poles which generate attraction and repulsion with respect to the magnet 2 are formed in the yokes 3, 3' and those force act as the propulsion force of the hammer 1.

Along with the propulsion of the hammer 1, the maintenance force of the hammer 1 acts as a return force but this force tends to decrease gradually and therefore, printing operation at a higher speed becomes possible as compared with the device which uses a spring member to return the hammer and in which the return force is increased with the propulsion of the hammer.

FIG. 4(3) shows a condition in which the hammer 6 biased in the direction of arrow A has been stopped by a stop, not shown, and the polarization lines of the permanent magnet 7 are controlled at positions not deviated from the surfaces 5*a*, 5*b*, 5'*a* and 5'*b* of the yokes.

When the current to the coils is cut off in this condition, a return force C trying to return the hammer to its home position acts on the hammer. If a signal is applied to the coils so that the yokes assume the polarities shown in FIG. 4(4) to effect printing, said return force is doubled and the hammer is moved in the printing direction B. FIG. 4(5) shows the condition during printing and in this case, a platen is provided at a position whereat the polarization lines of the permanent magnet are not deviated from the surfaces 5*a*, 5*b*, 5'*a* and 5'*b* of the yokes, whereby the hammer is stopped. When the current to the coils is cut off, the hammer quickly returns to its home position due to the return force C.

Thus, according to the present embodiment, the drive control of the hammer can be accomplished only by the supply and cut-off of current to the coils without using the mechanical force of a return spring member or the like and this leads to simplification of the construction and higher speed of operation.

Figure 5:
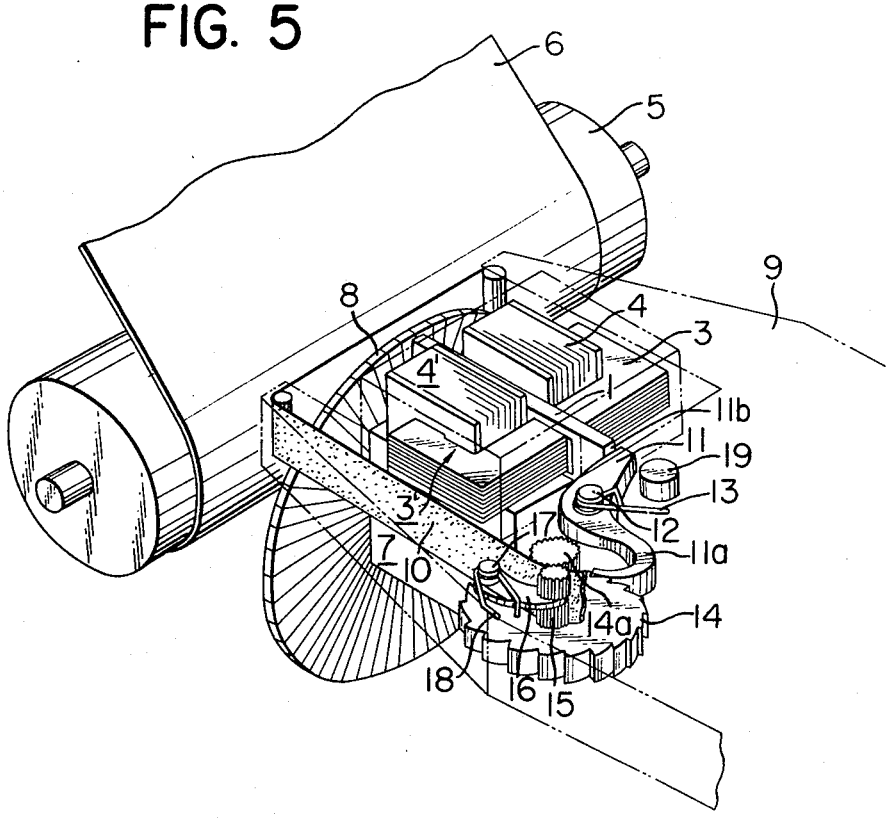
FIG. 5 is a perspective view of an embodiment of the present invention.

FIG. 5 shows a printing mechanism incorporating said hammer mechanism therein and an ink ribbon feed mechanism. Reference numeral 5 designates a platen, reference numeral 6 denotes printing paper, and reference numeral 7 designates a motor for driving a daisy type printing wheel 8 as a printing member. Designated by 9 is an ink ribbon cassette removable with respect to a carriage (not shown). The ink ribbon cassette 9 contains an ink ribbon 10 therein and also acts as a guide for moving the ink ribbon round to the printing position. Denoted by 11 is a pawl lever rotatably supported on a shaft 12 provided in the cassette 9. The end pawl portion 11*a* of the pawl lever 11 has sufficient resiliency and is in engagement with a ratchet wheel 14. Designated by 13 is a torsion coil spring which imparts a torque to the pawl lever so that one side 11*b* of the pawl lever is always in contact with one end of the hammer. The ratchet wheel 14 is rotatably held by the cassette 10 and drives the ink ribbon 10 by a drive roller 14*a* formed integrally and coaxially with the ratchet wheel and a pinch roller 15. The pinch roller 15 is held by a lever 16 rotatably supported on a shaft 17 provided in the ink ribbon cassette 9, and is urged against the drive roller 14*a* by a spring 18. Designated by 19 is a stop for controlling the over-swing of the pawl lever 11. The stop 19 is secured to the carriage. Operation of the printing mechanism will now be described.

When the hammer is biased in the non-printing direction A, the pawl lever 11 is rotated against the force of the spring 13 until it bears against the stop 19, and the pawl lever feeds the ratchet wheel 14 by an amount corresponding to one tooth with the aid of its end 11*a*. Since the drive roller 14 is integral with the ratchet wheel 14, rotation of the ratchet wheel 14 feeds the ink ribbon 10 by a predetermined length. When the hammer 1 returns to its home position, the pawl lever 11 is also returned to its rest position by the spring 13 and at that time, the end 11*a* of the pawl lever which is resilient yields to engage the next tooth of the ratchet wheel 14. In that case, there is some possibility that the ratchet wheel will be reversely rotated, but this can be prevented by rendering the urging of the pinch roller 15 proper. Subsequently, the hammer 1 is biased in the printing direction B and the ink of the ink ribbon 10 is transferred to the printing paper 6 in the form of a character, thus effecting the printing, whereafter the hammer is returned to its home position by the return force C.

Figure 6:
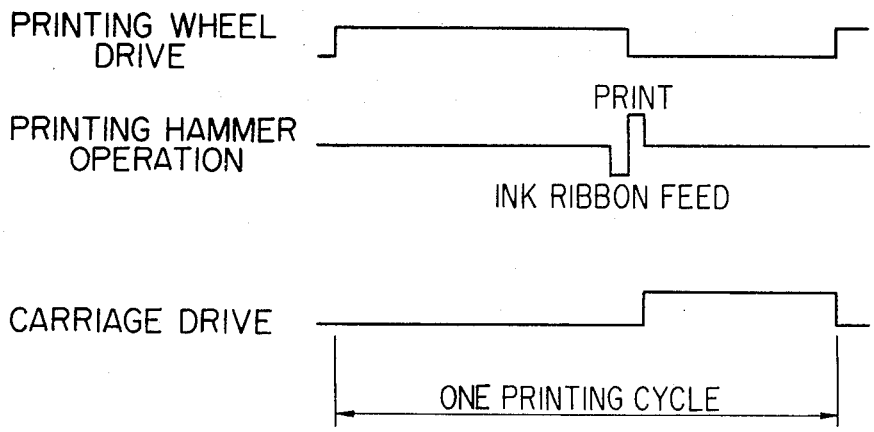
FIG. 6 is a timing chart thereof.

FIG. 6 is a timing chart showing the above-described series of operations and the timing of the printing wheel drive and carriage drive.

In the present embodiment, as has been described above, the printing operation and an operation other than printing, such as ink ribbon feeding, are effected by one reciprocal movement of a single drive source and this leads to reduction in the number of drive source and control system electrical elements and hence to the provision of an inexpensive printer.

The present invention is not limited to the above-described embodiment, but for example, the movable member may be not only the printing hammer but also a lever for selecting the printing position of the printing wheel and further, the printing member may be a printing wheel having characters arranged on its periphery, and the printer to which the present invention is applicable may be of the type in which the printing member is impacted by a hammer with printing paper or ink ribbon interposed therebetween or the type in which a platen is impacted by a printing wheel with printing paper or ink ribbon interposed therebetween.

Further, the number into which the magnet placed on the hammer is divided and the number of yokes disposed in opposed relationship therewith may be changed freely.

What we claim is:

1. An electromagnetic driving mechanism, comprising:

a rectilinearly reciprocal member having a magnetic portion having poles, the poles of said magnetic portion being aligned substantially in parallel with a line in the direction of reciprocation of said member and being separated by a line of polarization;

a plurality of yokes disposed substantially at right angles to said line of reciprocation and opposed to said magnetic portion, such that said polarization line opposes the surfaces of said yokes; and coils wound on said yokes for controlling the reciprocation of said member.

2. The electromagnetic driving mechanism of claim 1, wherein said yokes are U-shaped and are disposed symmetrically with respect to said magnetic portion.

3. The electromagnetic driving mechanism of claim 2, wherein said magnetic portion has a plurality of polarization lines and the distance between adjacent polarization lines is equal to the space between respective central points of said surfaces of said U-shaped yokes.

4. A printer comprising:

a rectilinearly reciprocal member having a magnetic portion having poles, the poles of said magnetic portion being aligned substantially in parallel with a line in the direction of reciprocation of said member and being separated by a line of polarization;

a plurality of yokes disposed substantially at right angles to the line of reciprocation and opposed to said magnetic portion, such that the polarization line opposes the surfaces of said plurality of yokes; and coils wound on said plurality of yokes for controlling the reciprocation of said reciprocal member; and a printing member for selectively printing on a recording medium when struck by said reciprocal member.

5. A printer according to claim 4, further comprising a driving means for generating a force to maintain said reciprocal member in its print positions and to return said reciprocal member to its non-print portion.

6. A printer according to claim 5, wherein said driving means generates a propulsion force when a voltage is applied thereto and provides means for turning the voltage on and off.

7. A printer according to claim 4, wherein said movable member has a magnet integral therewith.

8. A printer according to claim 7, wherein said magnet is magnetized to multipoles in the direction of movement of said movable member and sets up a polarization line, and the polarization line of said magnet is disposed substantially at the position of a bisecting line of the surface of said yokes which is opposed to said magnet.

9. A printer according to claim 7 or 8, wherein said yokes are U-shaped and disposed symmetrically with respect to said magnet.

* * * * *